US006595130B2

(12) United States Patent
Uehara

(10) Patent No.: US 6,595,130 B2
(45) **Date of Patent: *Jul. 22, 2003**

(54) PRINTING PRESS

(75) Inventor: Takeo Uehara, Chiba (JP)

(73) Assignee: Komori Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/974,860

(22) Filed: Oct. 12, 2001

(65) Prior Publication Data

US 2002/0043167 A1 Apr. 18, 2002

(30) Foreign Application Priority Data

Oct. 13, 2000 (JP) ..... 2000-312975

(51) Int. Cl.[7] ..... B41F 5/02
(52) U.S. Cl. ..... 101/216; 101/174; 101/132
(58) Field of Search ..... 101/216, 174, 101/232

(56) References Cited

U.S. PATENT DOCUMENTS 4,414,896 A * 11/1983 Fischer ..... 101/211
4,448,121 A 5/1984 Uno et al.
5,329,852 A * 7/1994 Bolza-Schuenemann et al. ..... 101/232
5,666,881 A * 9/1997 Zanoli ..... 101/477
5,839,366 A * 11/1998 Schaede ..... 101/232
6,302,016 B1 10/2001 Fausto et al.

FOREIGN PATENT DOCUMENTS

EP 0985548 A 3/2000
FR 682097 A * 5/1930
JP 57205153 A * 6/1981

* cited by examiner

*Primary Examiner*—Andrew H. Hirshfeld
*Assistant Examiner*—Jill E. Culler
(74) *Attorney, Agent, or Firm*—Birch, Stewart, Kolasch & Birch, LLP

(57) ABSTRACT

A printing press includes an impression cylinder, a seal cylinder, two number printing cylinders, and a transfer cylinder. The distance $L_1$ between the outer circumference of the impression cylinder and the outer circumference of the impression cylinder, and the distance $L_2$ between the outer circumference of the impression cylinder and the outer circumference of the impression cylinder are set longer than the sheet length $L_o$ of the effective printing area of the sheet, and the distance $L_3$ between the outer circumference of the impression cylinder and the outer circumference of the impression cylinder is set shorter than the sum of the effective impression area length $L_a$ of the impression cylinder and double of length $L_b$ of the notch of the impression cylinder, and an inspection portion for inspecting the sheet supplied to the impression cylinder is also provided.

7 Claims, 9 Drawing Sheets

Related Art

PRINTING PRESS

The entire disclosure of Japanese Patent Application No.2000-312975 filed on Oct. 13, 2000 including specification, claims, drawings, and summary is incorporated herein by reference in its entirety.

BACKGROUND OF THE INVENTION

1. Field of the Invention

The present invention relates to a printing press, particularly effective when applied in printing of seals and numbers on stock securities or bank notes.

2. Related Art

An example of outline structure of a conventional printing press for printing seals and numbers on stock securities or bank notes is shown in FIG. 9.

As shown in FIG. 9, a paper feeder 110 has a pile board 111 for stacking up sheets 100 on which patterns have been already printed. The paper feeder 110 also includes a feeder board 112 for feeding the sheets 100 on the pile board 111 to a printing unit 120 one by one. At the leading end of the feeder board 112, a swing device 113 is disposed for transferring the sheets 100 to a transfer cylinder 121*a*.

The transfer cylinder 121*a* is opposing an impression cylinder 122*a* of the printing unit 120 through transfer cylinders 121*b*, 121*c*. A seal cylinder 123 for printing seals is opposing the impression cylinder 122*a*. A roller group of an ink feeder 124 is opposing the seal cylinder 123. Number printing cylinders 125*a*, 127*a* for printing numbers are opposing the impression cylinder 122*a*. A roller group of an ink feeder 126*a* is opposing these number printing cylinders 125*a*, 127*a*. A transfer cylinder 121*d* is opposing the impression cylinder 122*a*. An impression cylinder 122*b* is opposing the transfer cylinder 121*d*. Number printing cylinders 125*b*, 127*b* for printing numbers are opposing the impression cylinder 122*b*. A roller group of an ink feeder 126*b* is opposing these number printing cylinders 125*b*, 127*b*. A delivery cylinder 129 is opposing the impression cylinder 122*b*.

A sprocket 131 is coaxially disposed on the delivery cylinder 129. A sprocket 132 is provided in a delivery unit 130. A delivery chain 133 is stretched between these sprockets 131 and 132. Delivery grippers 134 are disposed at specified intervals in the delivery chain 133. The delivery unit 130 has piles 135*a* to 135*c* for stacking up sheets 100 after printing of seals and numbers.

In such printing press, when the sheets 100, on which patterns are already printed, are transferred onto the transfer cylinder 121 from the pile board 111 of the paper feeder 110 through the feeder board 112, the sheets 100 are transferred to the impression cylinder 122*a* of the printing unit 120 through the transfer cylinders 121*b*, 121*c*, and seals are printed by the seal cylinder 123 and numbers are printed by the number printing cylinders 125*a*, 127*a*, and successively they are transferred to the impression cylinder 122*b* through the transfer cylinder 121*d*, and numbers are printed by the number printing cylinders 125*b*, 127*b*, and they are gripped by the delivery gripper 134 of the delivery unit 130 through the delivery cylinder 129, and conveyed along with running of the delivery chain 133, and discharged onto delivery tables 135*a* to 135*c*.

SUMMARY OF THE INVENTION

However, such conventional printing press had the following problems.

(1) Since numbers are printed by the numbering cylinder 125*a* while printing seals on the sheets 100 by the seal cylinder 123, printing by the seal cylinder 123 may be slightly deviated by light vibration while number printing by the number printing cylinder 125*a*, thereby resulting in wasted paper.

(2) Since gripping of sheets 100 is changed from the impression cylinders 122*a*, 122*b* to the transfer cylinder 121*d* or delivery cylinder 129 while printing numbers on the sheets 100 by the number printing cylinders 127*a*, 127*b*, the terminal end of the sheets 100 may be pulled by the number printing cylinders 127*a*, 127*b* by the ink while number printing, and gripping failure of sheets 100 may occur in the transfer cylinder 121*d* or delivery cylinder 129, and the sheets 100 may be dropped, or the terminal end of the sheets 100 may be pulled to the transfer cylinder 121*d* side or delivery cylinder 129 side, and number printing failure or waste of paper may occur.

Accordingly, a printing press capable of minimizing such loss of sheets 100 has been keenly demanded.

BRIEF SUMMARY OF THE INVENTION

To solve the problems, the printing press of the present invention comprises an impression cylinder for receiving sheet-like object and holding the sheet-like object, a first printing portion for printing the sheet-like object held by the impression cylinder, a second printing portion disposed at transport direction downstream side of the first printing portion for printing the sheet-like objects held by the impression cylinder, a number printing portion disposed at transport direction downstream side of the second printing portion for number printing the sheet-like object held by the impression cylinder, and a transport cylinder disposed at transport direction downstream side of the number printing portion for receiving the sheet-like object held by the impression cylinder, in which the distance between the outer circumference portion of the impression cylinder opposing the first printing portion and the outer circumference portion of the impression opposing the second printing portion and the distance between the outer circumference portion of the impression cylinder opposing the number printing portion and the outer circumference portion of the impression cylinder opposing the transport cylinder are set more than the length in the circumferential direction of the effective printing area of the sheet-like object, the distance between the outer circumference portion of the impression cylinder opposing the first printing portion and the outer circumference portion of the impression cylinder opposing the number printing portion is set less than the total length of the length of the effective impression are of the impression cylinder and double the length between adjacent effective impression areas of the impression cylinder, and an inspecting unit is further provided for inspecting the sheet-like object supplied to the impression cylinder.

This printing press may further comprise an accumulating unit for receiving and accumulating the sheet-like object from the transport cylinder, and a control unit for controlling the number printing portion to stop number printing on the sheet-like object when the sheet-like object do not satisfy the inspection standard on the basis of a signal from the inspecting unit, and controlling the accumulating unit to accumulate in a position different from the sheet-like object satisfying the inspection standard.

This printing press may further comprise the inspecting unit which inspects one side and other side of the sheet-like object.

This printing press may further comprise the inspecting unit which includes a first inspection cylinder rotatably supported, a first inspection camera for inspecting one side of the sheet-like object held in the first inspection cylinder, a second inspection cylinder rotatably supported, and a second inspection camera for inspecting other side of the sheet-like object held in the second inspection cylinder.

This printing press may further comprise the first inspection cylinder and the second inspection cylinder, which can be suction cylinders.

This printing press may further comprise a first contacting unit for attracting the sheet-like object to the first inspection cylinder side between the feed position for feeding the sheet-like object to the first inspection cylinder and the inspection position of the sheet-like object by the first inspection camera, and a second contacting unit for attracting the sheet-like object to the second inspection cylinder side between the feed position for feeding the sheet-like object to the second inspection cylinder and the inspection position of the sheet-like object by the second inspection camera.

This printing press may further comprise the first contacting unit and the second contacting unit, which can be brushes.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
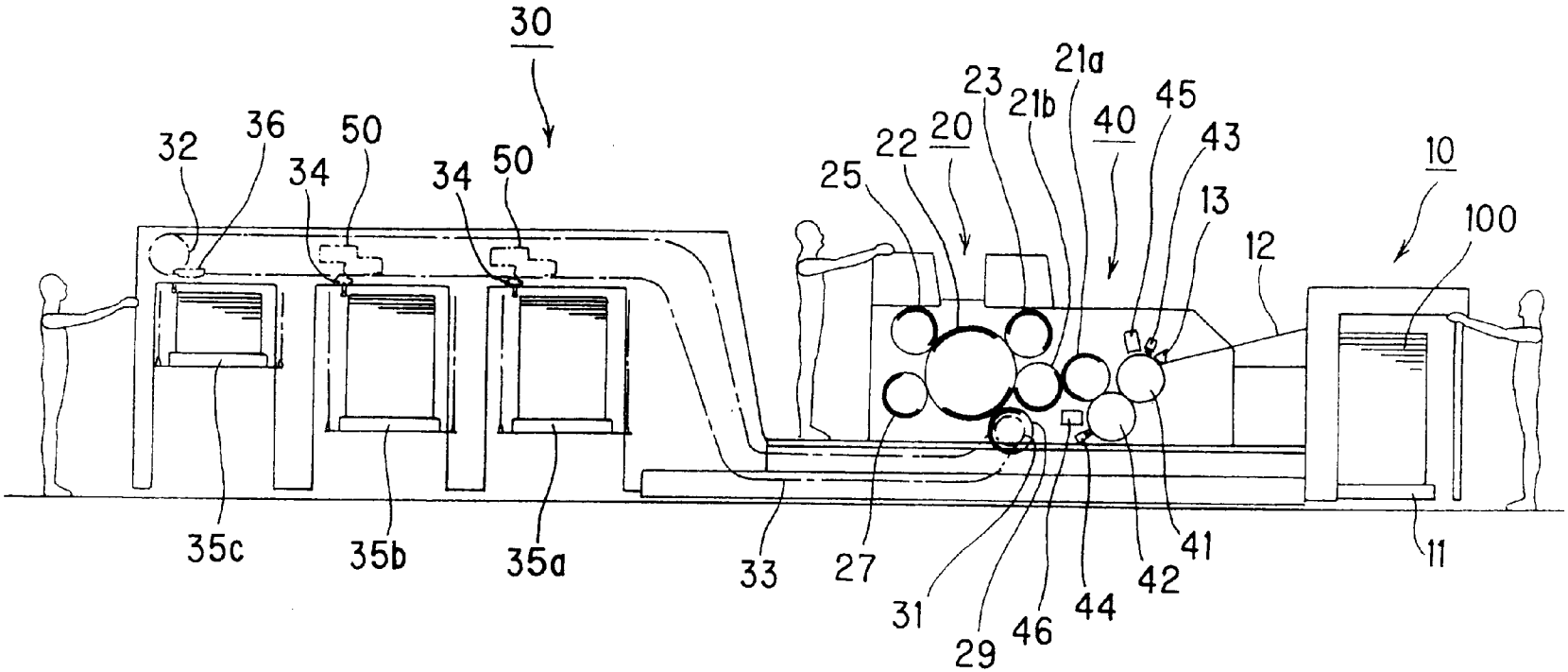
FIG. 1 is a general outline structural diagram of a printing press applied to an embodiment for printing seals and numbers on stock securities or bank notes.
Figure 2:
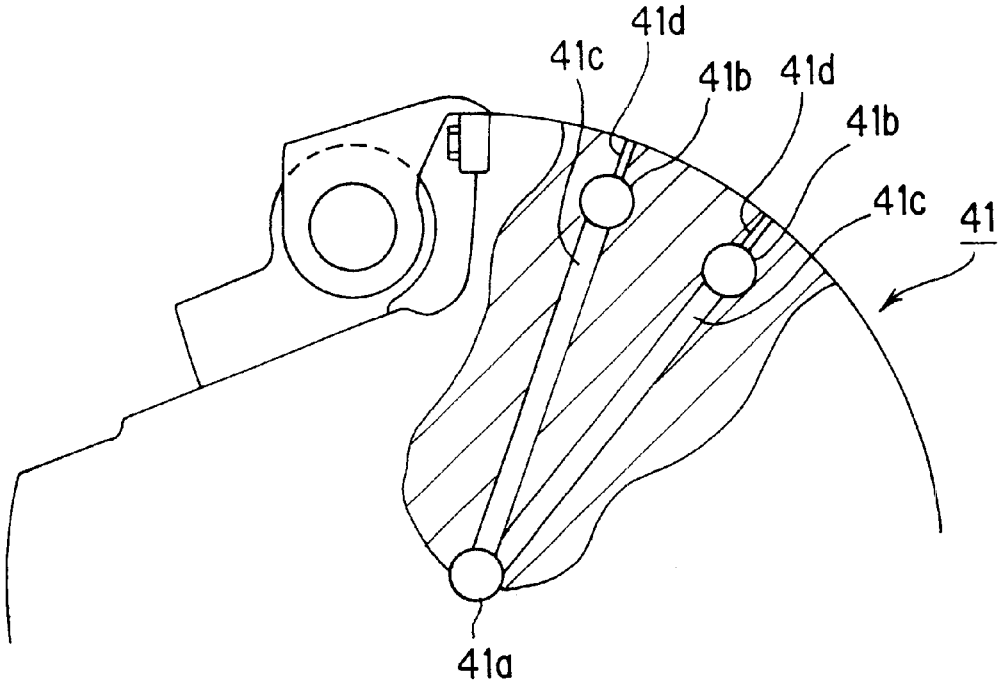
FIG. 2 is a partially cut-away view of an inspection cylinder in FIG. 1.
Figure 3:
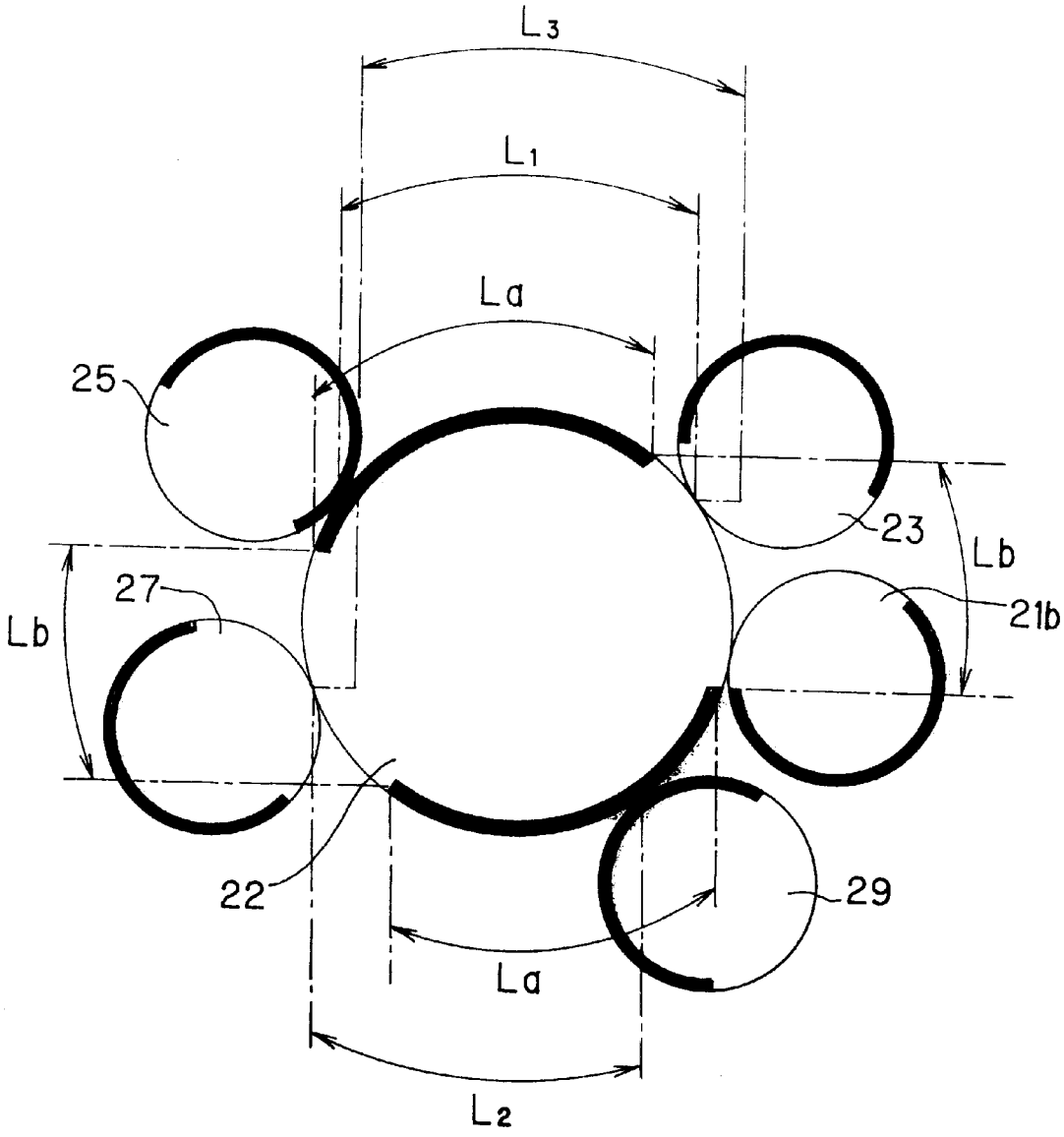
FIG. 3 is an essential extracted magnified view of a printing unit in FIG. 1.
Figure 4:
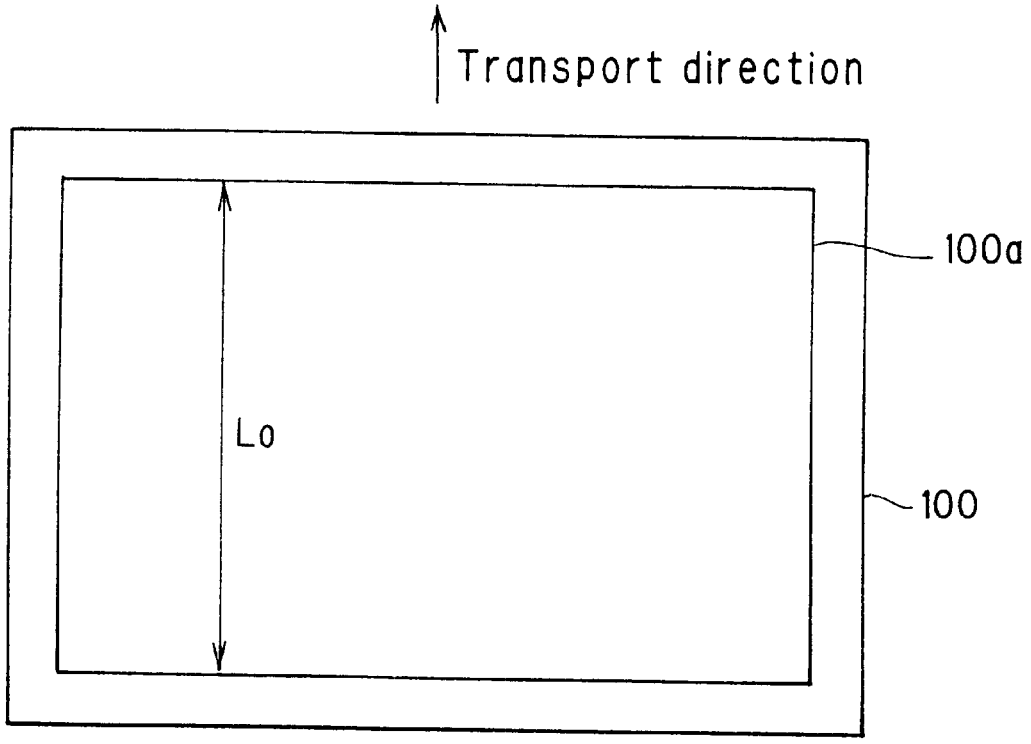
FIG. 4 is a plan view of a sheet.
Figure 5:
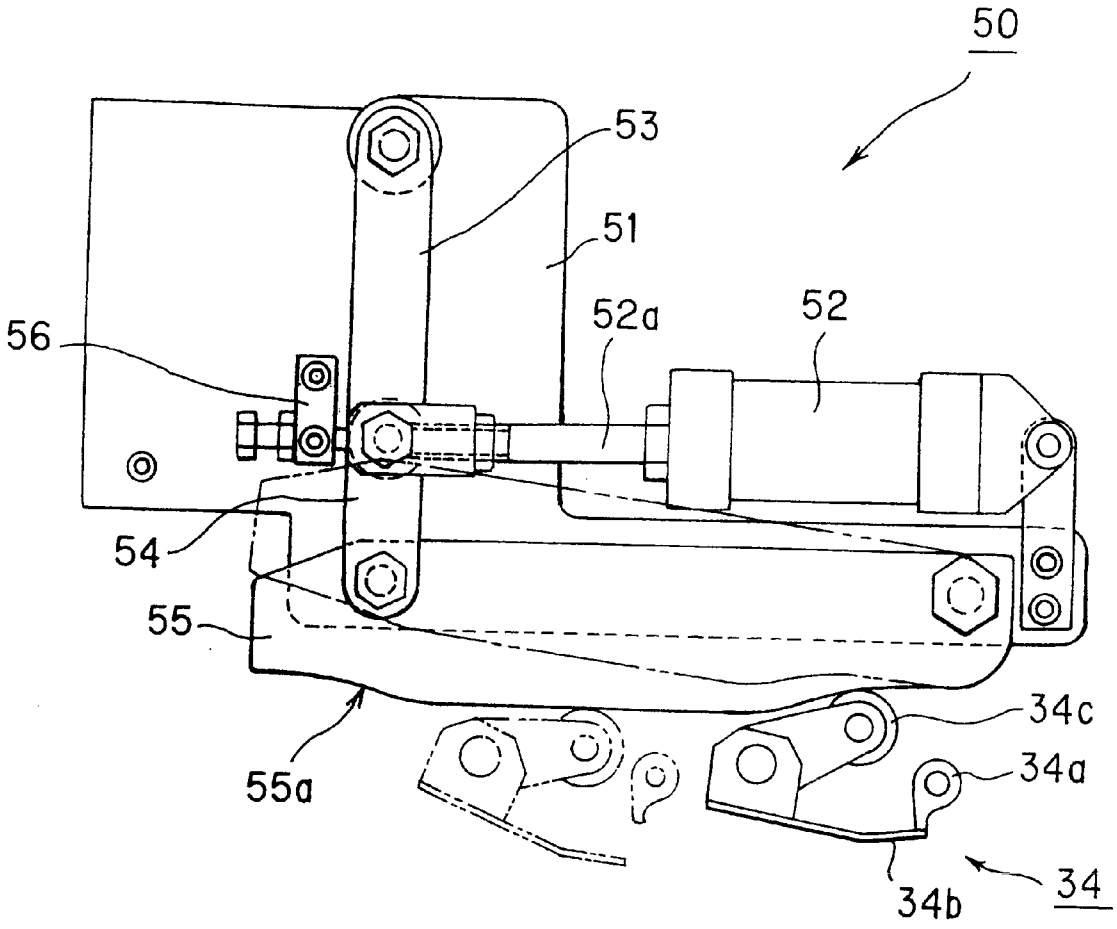
FIG. 5 is an outline structural diagram of a delivery gripper operation changeover device.
Figure 6:
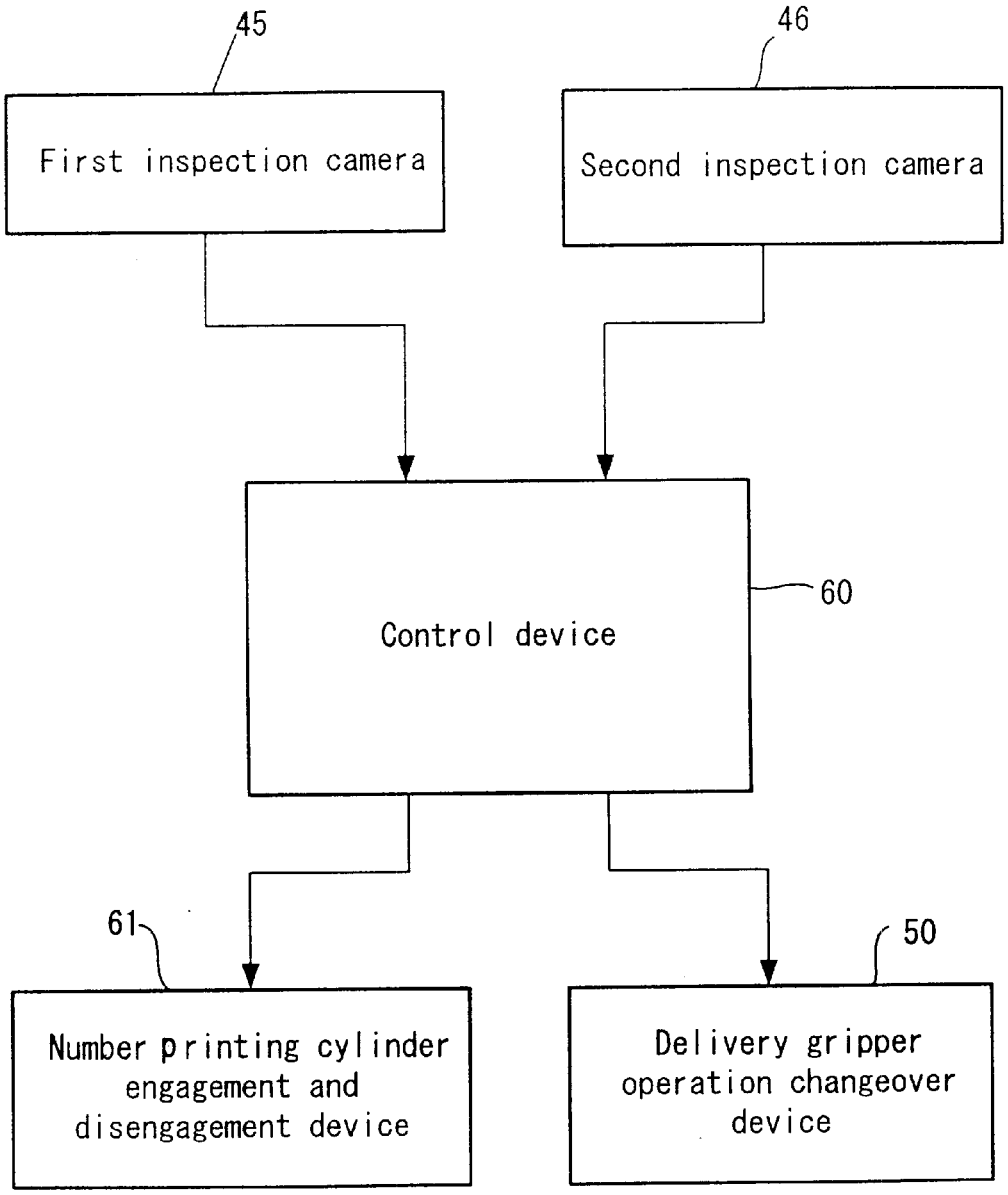
FIG. 6 is a control block diagram of inspection system of printing quality of sheet.
Figure 7:
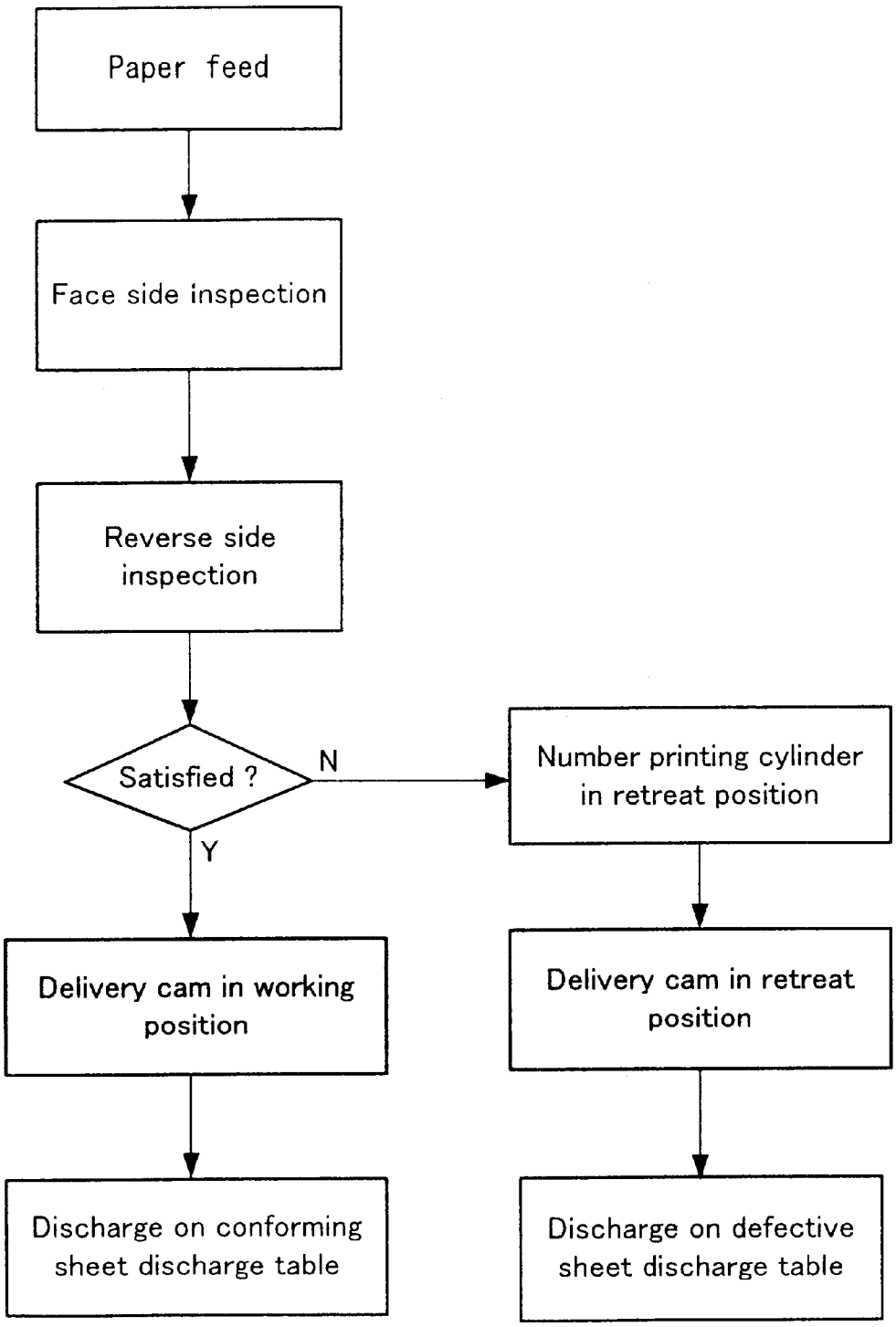
FIG. 7 is a control flowchart of inspection system of printing quality of sheet.

An embodiment of the printing press of the invention applied in printing of seals and numbers on stock securities and bank notes is explained by referring to FIG. 1 to FIG. 7. FIG. 1 is a general outline structural diagram of a printing press, FIG. 2 is a partially cut-away view of an inspection cylinder, FIG. 3 is an essential extracted magnified view of a printing unit, FIG. 4 is a plan view of a sheet, FIG. 5 is an outline structural diagram of a delivery gripper operation changeover device, FIG. 6 is a control block diagram of inspection system of printing quality of sheet, and FIG. 7 is a control flowchart of inspection system of printing quality of sheet.

As shown in FIG. 1, a paper feeder 10 has a pile board 11. The paper feeder 10 also includes a feeder board 12 for feeding the sheets 100 on the pile board 11 to an inspection unit 40 one by one. At the leading end of the feeder board 12, a swing device 13 is disposed for transferring the sheets 100 to a first inspection cylinder 41 of the inspection unit 40.

The first inspection cylinder 41 includes, as shown in FIG. 2, a central path 41*a* formed along an axial center of the cylinder 41 in the axial center portion, plural distribution paths 41*b* formed at specified intervals with respect to the peripheral direction of the cylinder 41 and formed along the axial center direction near the outer circumference portion, a communication path 41*c* formed between the central path 41*a* and distribution paths 41*b* for communicating between them, and plural suction holes 41*d* formed between the distribution paths 41*b* and outer circumference portion for communicating between them. At the shaft end side of the central path 41*a* of the first inspection cylinder 41, a suction pump not shown is connected through a rotary joint not shown, and by operating the suction pump, the first inspection cylinder 41 can suck and hold the sheets 100 by way of the central path 41*a,* communication path 41*c,* distribution paths 41*b,* and suction holes 41*d.* That is, the first inspection cylinder 41 is a suction cylinder.

At the transport direction downstream side with respect to the transfer position of the sheet 100 with the swing device 13 of the first inspection cylinder 41, a brush 43, as first contacting means, is disposed to slide, so that the sheet 100 held by the first inspection cylinder 41 may be held uniformly on the outer circumference portion of the first inspection cylinder 41. At the transport direction downstream side of the sheet 100 with respect to the sliding position of the brush 43 on the first inspection cylinder 41, a first inspection camera 45 is disposed for checking the printing quality of the sheet 100. This first inspection camera 45 is disposed at a higher position than the axial center position of the first inspection cylinder 41 to prevent contamination of the lens by paper powder and dust as much as possible (in this embodiment, nearly above the first inspection cylinder 41).

At the transport direction downstream side of the sheet 100 with respect to the confronting position against the first inspection camera 45 of the first inspection cylinder 41, a second inspection cylinder 42 is disposed in an opposing manner, and the second inspection cylinder 42 is composed in the same manner as the first inspection cylinder 41. At the transport direction downstream side of the sheet 100 with respect to the confronting position against the first inspection cylinder 41 of the second inspection cylinder 42, a brush 44, as second contacting means, is disposed to slide, so that the sheet 100 held by the second inspection cylinder 42 may be held uniformly on the outer circumference portion of the second inspection cylinder 42. At the transport direction downstream side of the sheet 100 with respect to the sliding position of the brush 44 on the second inspection cylinder 42, a second inspection camera 46 is disposed for checking the printing quality of the sheet 100. This second inspection camera 46 is disposed at a higher position than the axial center position of the second inspection cylinder 42 to prevent contamination of the lens by paper powder and dust as much as possible (in this embodiment, nearly at a side position of the second inspection cylinder 42).

At the transport direction downstream side of the sheet 100 with respect to the confronting position of the second inspection camera 46 of the second inspection cylinder 42 an impression cylinder of the printing unit 20 is provided opposing the cylinder 42 through the transfer cylinders 21*a,* 21*b.*

At the transport direction downstream side of the sheet 100 with respect to the confronting position of of the transport cylinder 21*b* of the impression cylinder 22, a seal cylinder 23 for relief printing of seal is provided opposingly to be close to or apart from the impression cylinder 22 (cylinder engagement, disengagement). A roller group of ink feeder, not shown, is opposing this seal cylinder 23. At the transport direction downstream side of the sheet 100 with respect to the confronting position of the seal cylinder 23 of the impression cylinder 22, a number printing cylinder 25 for printing numbers is provided opposingly to be close to or apart from the impression cylinder 22 (cylinder engagement, disengagement). A roller group of ink feeder, not shown, is opposite this number printing cylinder 25. At the transport direction downstream side of the sheet 100 with respect to the confronting position of the number printing cylinder 25 of the impression cylinder 22, a number printing cylinder 27 for printing numbers is provided opposingly to be close to or apart from the impression cylinder 22 (cylinder engagement disengagement). A roller group of ink feeder, not shown, is opposing this number printing cylinder 27. At the transport direction downstream side of the sheet 100 with respect to the confronting position of the number printing cylinder 27 of the impression cylinder 22, a delivery cylinder 29 for discharging paper is provided in an opposing manner.

The impression cylinder 22 is a multiple cylinder (a double cylinder in this embodiment) having plural (two in the embodiment) effective impression areas for holding the sheets 100 (thick line portions in FIG. 1 and FIG. 3, nearly in the same length as the sheet length of the sheets 100) provided at specific interval along the circumferential direction of the cylinder 22, and gripping grippers are formed between the adjacent effective impression area to form a notch. On the other hand, the inspection cylinders 41, 42, transport cylinders 21*a*, 21*b*, single cylinder 23, and number printing cylinders 25, 27 are single cylinders having a single effective impression area and a single notch.

As shown in FIG. 3 and FIG. 4, the distance $L_1$ between the outer circumference portion of the impression cylinder 22 opposing the seal cylinder 23 and the outer circumference portion of the impression cylinder 22 opposing the number printing cylinder 25 is set longer than the sheet length $L_o$ (transfer direction) of the effective printing area 100*a* of the sheet 100 ($L_1 \geqq L_o$), the distance $L_2$ between the outer circumference portion of the impression cylinder 22 opposing the number printing cylinder 27 and the outer circumference portion of the impression cylinder 22 opposing the delivery cylinder 29 is set longer than the sheet length $L_o$ of the effective printing area 100*a* of the sheet 100 ($L_2 \geqq L_o$), and the distance $L_3$ between the outer circumference portion of the impression cylinder 22 opposing the seal cylinder 23 and the outer circumference portion of the impression cylinder 22 opposing the number printing cylinder 27 is set shorter than the sum ($L_a+2L_b$) of the effective impression area length La of the impression cylinder 22 and double the length $L_b$ between adjacent effective impression areas ($L_3 \leqq L_a+2L_b$).

On the other hand, as shown in FIG. 1, a sprocket 31 is coaxially provided on the delivery cylinder 29. A sprocket 32 is provided on the delivery unit 30. A delivery chain 33 is stretched between the sprockets 31 and 32. Delivery gripper devices 34 are disposed at specific interval in the delivery chain 33. The delivery unit 30 comprises conforming sheet discharge tables 35*a*, 35*b* for piling up sheets 100 that satisfy the inspection standard (conforming sheet), and a defective sheet discharge table 35*c* for piling up sheets 100 that do not satisfy the inspection standard (defective sheet). At an upper position of the defective sheet discharge table 35*c* near the delivery chain 33, a fixed delivery cam 36 for operating the delivery gripper devices 34 is provided. At an upper position of the conforming sheet discharge tables 35*a*, 35*b* near the delivery chain 33, a delivery gripper operation changeover device 50 is provided for changing over presence or absence of operation of the delivery gripper devices 34, and this delivery gripper operation changeover device 50 has a structure as shown in FIG. 5.

As shown in FIG. 5, at the running direction upstream side of the delivery chain 33 at the lower side of a base plate 51 attached to the frame of the delivery unit 30, the base end side of an air cylinder 52 is swingably supported. At the leading end side of the rod 52*a* of the air cylinder 52, end sides of link plates 53, 54 are rotatably coupled. Other end side of the link plate 53 is rotatably coupled and supported at the running direction downstream side of the delivery chain 33 at the upper side of the base plate 51. At the running direction upstream side of the delivery chain 33 at the lower side of the base plate 51, one end side of a delivery cam 55 of a plate shape having a cam surface 55*a* at the lower side is rotatably coupled and supported. Other end side of the delivery cam 55 is rotatably coupled and supported at other end side of the link plate 54.

That is, in the delivery gripper operation changeover device 50, when the rod 52*a* of the air cylinder 52 contracts, one end side of the link plate 53 oscillates about the other end side, and one end side of the link plate 54 moves upward while other end side of the link plate 54 is pulled up, and the other end side of the delivery cam 55 is pulled up and the delivery cam 55 moves to the retreat position, and on the other hand, when the rod 52*a* of the cylinder 52 extracts, one end side of the link plate 53 moves about the other end side, and one end side of the link plate 54 moves downward while the other end side of the link plate 54 is pulled down, and the other end side of the delivery cam 55 is pulled down, and the delivery cam 55 moves to the working position. In FIG. 5, reference numeral 56 is a stopper for defining the extracted position of the rod 52*a* of the air cylinder 52.

On the other hand, as shown in FIG. 5, the delivery gripper device 34, provided in the delivery chain 33, includes a gripper pad 34*a* supported by the delivery chain 33, a gripper 34*b* disposed on the gripper pad 34*a* so as to be free to open and close, a spring, not shown, for moving the gripper 34*b* in the closing direction, and a cam follower 34*c* provided integrally with the gripper 34*b*.

That is, in the delivery gripper device 34, when the delivery cam 55 is moved to the working position by extracting the rod 52*a* of the air cylinder 52 of the delivery gripper operation changeover device 50, along with running and moving of the delivery chain 33, the cam follower 34*c* moves while contacting with the cam surface 55*a* of the delivery cam 55 of the delivery gripper operation changeover device 50, and the gripper 34*b* opens at a specified position, and when the delivery cam 55 is moved to the retreat position by contracting the rod 52*a* of the air cylinder 52 of the delivery gripper operation changeover device 50 as mentioned above, along with running and moving of the delivery chain 33, the cam follower 34*c* directly passes through without contacting with the cam surface 55*a* of the delivery cam 55 of the delivery gripper operation changeover device 50, and the gripper 34*b* is kept closed.

Further, as shown in FIG. 6, the first inspection camera 45 and second inspection camera 46 are connected to an input portion of a control device 60 which is control means. An output portion of the control device 60 is connected to a number printing cylinder engagement and disengagement device 61 (for example, an air cylinder for turning the eccentric bearing for supporting the number printing cylinders 25, 27) for engaging and disengaging the number printing cylinders 25, 27, and the delivery gripper operation changeover device 50. That is, the control device 60 controls the devices 61, 50 on the basis of the signals from the cameras 45, 46 (the detail is described below).

In the embodiment, the seal cylinder 23, ink feeder, and others are combined to compose the first printing portion, the number printing cylinder 25, ink feeder, number printing cylinder engagement and disengagement device 61, and others compose the second printing portion, the number printing cylinder 27, ink feeder, number printing cylinder engagement and disengagement device 61, and others compose the number printing portion, the first and second inspection cylinders 41, 42, brushes 43, 44, first and second inspection cameras 45, 46, suction pump, control device 60, and others compose the inspection means, the sprockets 31, 32, delivery chain 33, delivery gripper device 34, conforming sheet discharge tables 35*a*, 35*b*, defective sheet discharge table 35*c*, delivery cam 36, delivery gripper operation changeover device 50, and others compose the accumulating means, and the control device 60 and others compose the control means.

In the printing press thus composed, when a sheet 100, on which a pattern is already printed, is transferred from the pile board 11 of the paper feeder 10 to the first inspection cylinder 41 by way of the feeder board 12, the sheet 100 is sucked and held on the outer circumference portion of the first inspection cylinder 41, and is attracted uniformly by the brush 43, and the printing quality of one side (face side) is inspected by the first inspection camera 45, and transferred from the first inspection cylinder 41 to the second inspection cylinder 42. The sheet 100 is sucked and held on the outer circumference portion of the second inspection cylinder 42, and is attracted uniformly by the brush 43, and the printing quality of other side (reverse side) is inspected by the second inspection camera 46, and transferred to the transport cylinder 21*a*.

At this time, the control device 60 evaluates the printing quality of the sheet 100 on the basis of the signals from the inspection cameras 45, 46, and when the printing quality of this sheet 100 satisfies the inspection standard, the number printing cylinder engagement and disengagement device 61 is operated to engage the number printing cylinders 25, 27, and also the air cylinder 52 of the delivery gripper operation changeover device 50 is operated to move the delivery cam 55 of the delivery gripper operation changeover device 50 to the working position.

The sheet 100 transferred to the transport cylinder 21*a* is handed over to the impression cylinder 22 of the printing unit 20 through the transport cylinder 21*b*, and the seal is printed by the seal cylinder 23, and the numbers are printed by the number printing cylinders 25, 27, and the sheet 100 is gripped by the delivery gripper device 34 of the delivery unit 30 through the delivery cylinder 29.

Herein, as mentioned above, since the distance $L_1$ between the outer circumference portion of the impression cylinder 22 opposing the seal cylinder 23 and the outer circumference portion of the impression cylinder 22 opposing the number printing cylinder 25 is set longer than the sheet length $L_o$ (transfer direction) of the effective printing area 100*a* of the sheet 100 ($L_1 \geqq L_o$), after the seal is printed on the sheet 100 by the seal cylinder 23, the number is printed on this sheet 100 by the number printing cylinder 25. Accordingly, when printing the number by the number printing cylinder 25, it is free from effects of slight vibration at the time of printing by the seal cylinder 23, so that occurrence of wasted paper can be suppressed.

Moreover, since the distance $L_2$ between the outer circumference portion of the impression cylinder 22 opposing the number printing cylinder 27 and the outer circumference portion of the impression cylinder 22 opposing the delivery cylinder 29 is set longer than the sheet length $L_o$ of the effective printing area 100*a* of the sheet 100 ($L_2 \geqq L_o$), after printing the number on the sheet 100 by the number printing cylinder 27, gripping of the sheet 100 is changed from the impression cylinder 22 to the delivery cylinder 29. At this time of grip change, the terminal end of the sheet 100 is not pulled to the number printing cylinder 27 side by the ink while printing the number, the sheet 100 is securely gripped by the delivery cylinder 29, and also the terminal end of the sheet 100 is not pulled to the delivery cylinder 29 side while printing the number, the number can be printed securely, so that occurrence of wasted paper can be suppressed.

Further, since the distance $L_3$ between the outer circumference portion of the impression cylinder 22 opposing the seal cylinder 23 and the outer circumference portion of the impression cylinder 22 opposing the number printing cylinder 27 is set shorter than the sum ($L_a$+2$L_b$) of the effective impression area length $L_a$ of the impression cylinder 22 and double the length $L_b$ between adjacent effective impression areas ($L_3 \leqq L_a + 2L_b$), after printing the number on the sheet 100 by the number printing cylinder 27, printing of seal by the seal cylinder 23 on a new sheet 100 is started.

Accordingly, for instance, if the number printing cylinder 27 fails to advance the number printing sequence, by immediately throwing off the seal cylinder 23 and number printing cylinders 25, 27 (cylinder disengagement), printing of seal and number is stopped easily, and the second and subsequent sheets 100 from the sheet 100 of wrong number printing are saved. On the first sheet from the sheet 100 of wrong number printing, printing can be stopped after printing the seal and printing the correct number by the number printing cylinder 25, and therefore after checking and repairing the number printing cylinder 27, the correct number can be printed by the number printing cylinder 27, so that this sheet can be handled as a conforming one, not wasted paper. As a result, only one sheet 100 of wrong number printing is wasted, so that occurrence of wasted paper is suppressed.

When the sheet 100, gripped by the delivery gripper device 34, is conveyed onto the conforming sheet discharge table 35*a* along with running and moving of the delivery chain 33, the cam follower 34*c* of the delivery gripper device 34 contacts with the cam surface 55*a* of the delivery cam 55 at the working position of the delivery gripper operation changeover device 50, and the gripper 35*b* of the delivery gripper device 34 opens, and the sheet is piled up on the conforming sheet discharge table 35*a*.

At this time, when the sheets 100 are piled up on the conforming sheet discharge table 35 to a specified height, by a signal from a sensor not shown, the control device 60 moves the delivery cam 55 of the delivery gripper operation changeover device 50 on the conforming sheet discharge table 35*a* away to the retreat position, and operates the air cylinder 52 of the delivery gripper operation changeover device 50 to move the delivery cam 55 of the delivery gripper operation changeover device 50 on the conforming sheet discharge table 35*b* to the working position, thereby changing over the delivery of conforming sheets 100 from the conforming sheet discharge table 35*a* to the conforming sheet discharge table 35*b*. Thus, while printing the sheets 100, the sheet 100 on the conforming sheet discharge table 35*a* can be delivered. When the sheet 100 are piled up to a specified height on the conforming sheet discharge table 35*b*, same as in the case of the conforming sheet discharge table 35*a*, delivery of sheets 100 is changed over from the conforming sheet discharge table 35*b* to the conforming sheet discharge table 35*a*, and while printing the sheets 100, the sheet 100 on the conforming sheet discharge table 35*b* can be delivered.

On the other hand, if the sheet 100 does not satisfy the printing quality standard, the control device 60 operates the number printing cylinder engagement and disengagement device 61 to disengage the number printing cylinders 25, 27 (to move to the retreat position), and operates the air cylinder 52 of the delivery gripper operation changeover device 50 to move the delivery cam 55 of the delivery gripper operation changeover device 50 to the retreat position.

In this case, the sheet 100 transferred to the transport cylinder 21*a* is handed over to the impression cylinder 22 of the printing unit 20 through the transport cylinder 21*b*, and the seal is printed by the seal cylinder 23, but the number printing cylinders 25, 27 are disengaged (withdrawn to the retreat position), and number printing is stopped, and without printing of number, it is gripped by the delivery gripper device 34 of the delivery unit 30 through the delivery cylinder 29.

Accordingly, if defective sheet is mixed in the sheets 100 piled up on the pile board 11 of the paper feeder 10, number is not printed on the defective sheet, and occurrence of missing number is prevented, so that occurrence of wasted paper may be further decreased.

The sheet 100 thus gripped by the delivery gripper device 34 without printing of number is conveyed along with running and moving of the delivery chain 33, and the delivery cam 55 of the delivery gripper operation changeover device 50 is withdrawn to the retreat position, and it is directly carried onto the defective sheet discharge table 35*c* without being discharged on the conforming sheet discharge table 35*a* or 35*b*, and the cam follower 34*c* of the delivery gripper device 34 contacts with the cam surface of the delivery cam 36, and the gripper 34*b* of the delivery gripper device 34 is opened, so that it is discharged onto the defective sheet discharge table 35*c* and piled up at a different position from the conforming sheets 100, and the conforming sheet and defective sheet are clearly distinguished.

Thus, according to this printing press, occurrence of wasted paper can be substantially curtailed.

Since the inspection cylinders 41, 42 are single cylinders, the entire printing press is not increased in size.

In the embodiment, if the sheet 100 does not satisfy the printing quality standard, by disengaging the number printing cylinders 25, 27 (moving away to the retreat position), number printing on the sheet 100 is stopped, but number printing on the sheet 100 can be also stopped by stopping the operation of the number printing sequence mechanism of the number printing cylinders 25, 27.

Also in the embodiment, while printing the sheets 100, the seal cylinder 23 is always engaged, but if the sheet 100 does not satisfy the printing quality standard, the seal cylinder 23 may be also disengaged together with the number printing cylinders 25, 27.

Figure 8:
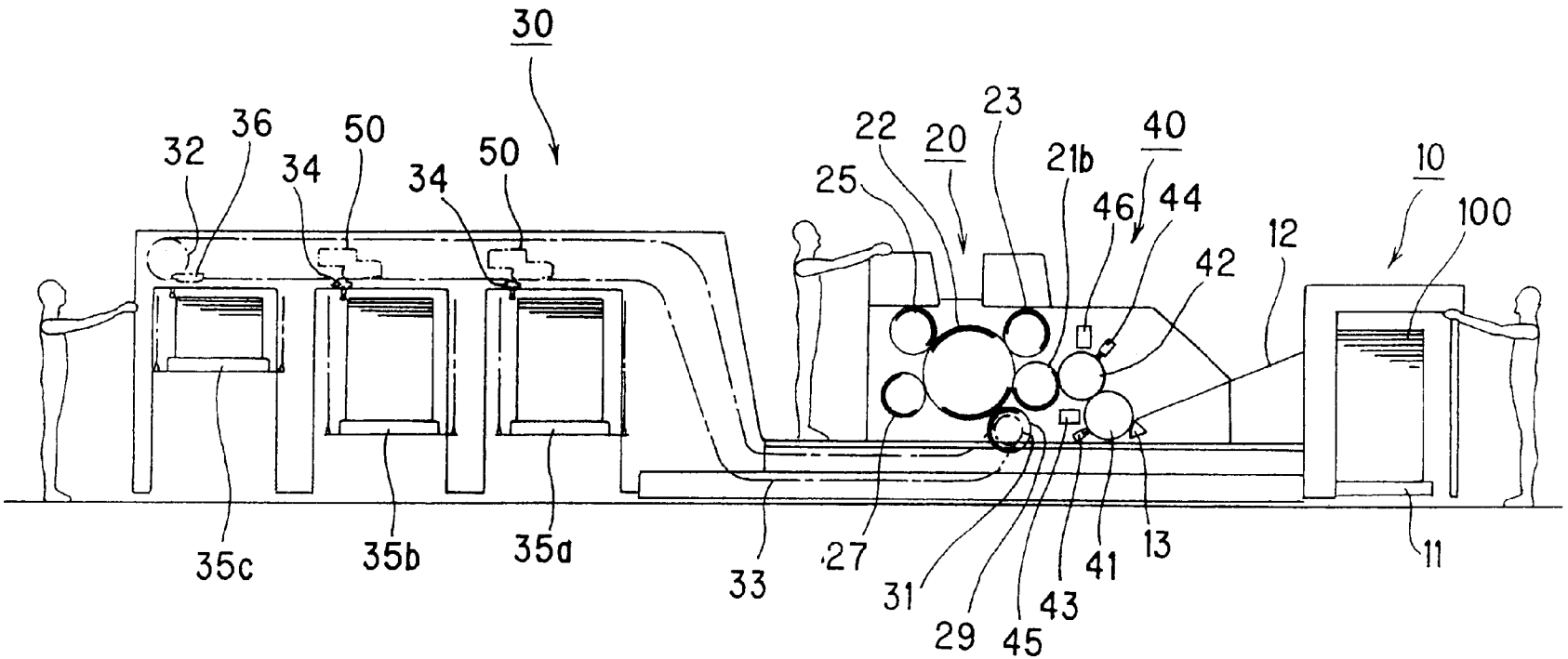
FIG. 8 is a general outline structural diagram of a printing press applied in other embodiment for printing seals and numbers on stock securities or bank notes.
Figure 9:
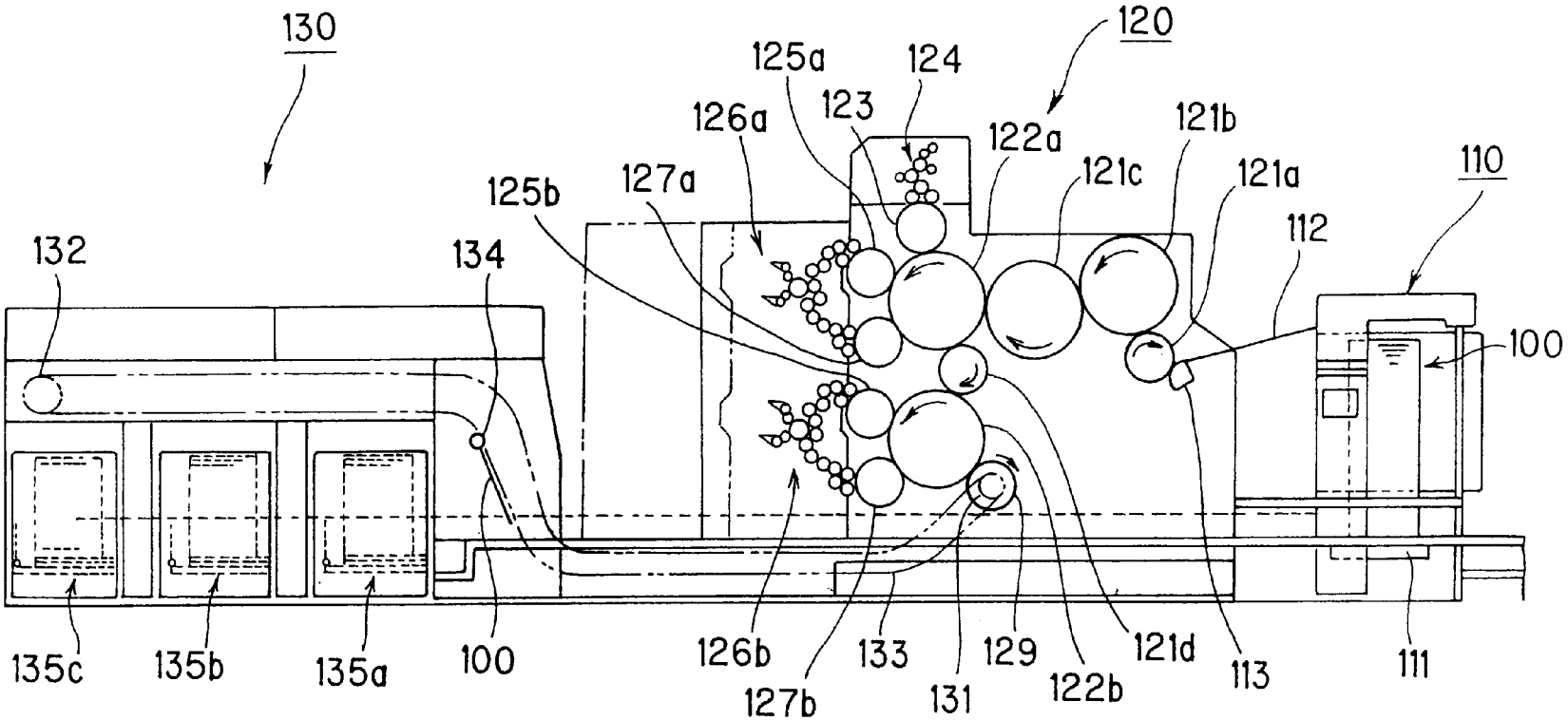
FIG. 9 is a general outline structural diagram of a printing press of a related art.

The embodiment uses the swing device 13 having the swinging fulcrum at the upper side, but, as shown in FIG. 8, by using a swing device 13 having the swinging fulcrum at the lower side, the sheet 100 can be transferred from the second inspection cylinder 42 to the impression cylinder 22 only by the transport cylinder 21*b*.

In the embodiment, the seal is directly printed from the relief seal cylinder 23, but offset printing of the seal is also possible from the plate cylinder by way of blanket cylinder. In this case, instead of the outer circumference portion of the impression cylinder 22 opposing the seal cylinder 23, the outer circumference portion of the impression cylinder opposing the blanket cylinder may be taken into consideration.

In the embodiment, the delivery cylinder 29 is used as the transport cylinder, and the sheet 100 are discharged from the delivery cylinder 29 onto the discharge tables 35*a* to 35*c* of the delivery unit 30 through the delivery chain 33, but the transfer cylinder may be used as the transport cylinder, and the sheet-like object may be transferred to the delivery cylinder through one or plural transfer cylinders, or sheet-like object may be transferred to a new printing unit through one or plural transfer cylinders.

In the embodiment, the second printing portion is composed of the number printing cylinder 25, ink feeder, and others, but the second printing portion may be also composed of general plate cylinder for printing ordinary patterns, ink feeder, and others.

In the embodiment, the double impression cylinder 22 is used, but triple or multiple diameter impression cylinder may be also used. In the case of the double impression cylinder, meanwhile, the angle formed by the line linking the outer circumference portion of the impression cylinder opposing the first printing portion and the axial center of the impression cylinder and the line linking the outer circumference portion of the impression cylinder opposing the number printing portion and the axial center of the impression cylinder is 180 degrees or less.

Also in the embodiment, brushes 43, 44 are used as first and second contacting means, but the invention is not limited to this example. For example, rollers, rolls, or other rotating elements may be also used as the first and second contacting means.

According to the printing press of the invention, loss of sheet-like object can be suppressed as much as possible.

The invention being thus described, it will be obvious that the same may be varied in many ways. Such variations are not to be regarded as a departure from the sprit and scope of the invention, and all such modifications as would be obvious to one skilled in the art are intended to be included within the scope of the following claims.

What is claimed is:

1. A printing press, comprising:

an impression cylinder for receiving a sheet and holding said sheet;

a first printing portion for printing said sheet held by said impression cylinder;

a second printing portion disposed downstream, with respect to the transport direction, of said first printing portion for printing said sheet held by said impression cylinder;

a number printing portion disposed downstream, with respect to the transport direction, of said second printing portion for number printing said sheet held by said impression cylinder; and a transport cylinder disposed downstream, with respect to the transport direction, of said number printing portion for receiving said sheet held by said impression cylinder, wherein a first distance between an outer circumference portion of said impression cylinder opposing said first printing portion and an outer circumference portion of said impression cylinder opposing said second printing portion, and a second distance between an outer circumferential portion of said impression cylinder opposing said number printing portion and an outer circumference portion of said impression cylinder opposing said transport cylinder are set larger than a length in a circumferential direction of an effective printing area of said sheet, and a third distance between the outer circumferential portion of said impression cylinder opposing said first printing portion and the outer circumference portion of said impression cylinder opposing said number printing portion is set smaller than a total length of the length of the effective impression are of said impression cylinder and double the length between adjacent effective areas of said impression cylinder; and inspecting means further provided for inspecting said sheet supplied to said impression cylinder.

2. The printing press of claim 1, further comprising:

accumulating means for receiving and accumulating said sheet from said transport cylinder; and control means for controlling said number printing portion to stop number printing on said sheet when said sheet does not satisfy an inspection standard based on a signal from said inspecting means, and controlling said accumulating means to accumulate the sheets that fail to satisfy the inspection standard in a position different from said sheet satisfying the inspection standard.

3. The printing press of claim 1, wherein said inspection means inspects one side and other side of said sheet.

4. The printing press of claim 3, wherein inspecting means includes a first inspection cylinder rotatably supported, a first inspection camera for inspecting one side of said sheet held in said first inspection cylinder, a second inspection cylinder rotatably supported, and a second inspection camera for inspecting the other side of said sheet held in said second inspection cylinder.

5. The printing press of claim 4, wherein said first inspection cylinder and said second inspection cylinder are suction cylinders.

6. The printing press of claim 4, further comprising:

first contacting means for attracting said sheet to said first inspection cylinder side between a feed position for feeding said sheet to said first inspection cylinder and an inspection position of said sheet by said first inspection camera, and second contacting means for attracting said sheet to said second inspection cylinder side between a feed position for feeding said sheet to said second inspection cylinder and an inspection position of said sheet by said second inspection camera.

7. The printing press of claim 6, wherein said first contacting means and said second contacting means are brushes.

* * * * *